US005624239A

United States Patent [19]

Osika

[11] Patent Number: 5,624,239

[45] Date of Patent: Apr. 29, 1997

[54] PORTABLE PNEUMATIC VACUUM SOURCE APPARATUS AND METHOD

[76] Inventor: Thomas W. Osika, 3321 Bridgeford Rd., Omaha, Nebr. 68124

[21] Appl. No.: 355,499

[22] Filed: Dec. 14, 1994

[51] Int. Cl.[6] ..... F04F 5/48

[52] U.S. Cl. ..... 417/187; 417/182; 15/409

[58] Field of Search ..... 417/182, 185, 417/186, 187, 313; 15/409

[56] References Cited

U.S. PATENT DOCUMENTS

| | | | |
|---|---|---|---|
| 2,682,886 | 7/1954 | Paxton | 417/187 |
| 2,874,566 | 2/1959 | Mastak | 73/40 |
| 3,369,392 | 2/1968 | Christensson | 73/49.2 |
| 3,377,844 | 4/1968 | Gandolfo | 73/49.2 |
| 3,452,751 | 7/1969 | Austin | 417/182 |
| 3,516,405 | 6/1970 | Hopper | 417/187 |
| 3,527,909 | 9/1970 | Torre | 200/83 |
| 4,157,656 | 6/1979 | Walle | 73/49.2 |
| 4,294,107 | 10/1981 | Walle | 73/49.2 |
| 4,341,534 | 7/1982 | Bürger | 55/55 |
| 4,542,643 | 9/1985 | Himmelstein | 73/49.2 |
| 4,759,691 | 7/1988 | Kroupa | 417/174 |
| 4,762,467 | 8/1988 | Ackermann | 417/185 |

FOREIGN PATENT DOCUMENTS

| | | | |
|---|---|---|---|
| 56-110033 | 9/1981 | Japan . | |
| 61-82128 | 4/1986 | Japan . | |
| 748158 | 7/1980 | U.S.S.R. . | |
| 0892033 | 12/1981 | U.S.S.R. | 417/182 |
| 1145254A | 3/1985 | U.S.S.R. . | |

*Primary Examiner*—Timothy Thorpe
*Assistant Examiner*—William Wicker
*Attorney, Agent, or Firm*—John A. Beehner

[57] ABSTRACT

A portable pneumatic vacuum source includes a source of pressurized fluid and a vacuum pump in fluid connection with the pressurized fluid source, the vacuum pump operative to generate a vacuum in response to pressurized fluid flow therethrough. A nozzle is included in vacuum connection with the vacuum pump. A pressure regulator and filter combination is interposed between and in fluid connection with the pressurized fluid source and vacuum pump for adjusting pressure of the pressurized fluid entering the vacuum pump and for filtering particulates and liquids from the pressurized fluid. A relief valve is also interposed between and in fluid connection with the pressurized fluid source and vacuum pump for limiting pressure of the pressurized fluid. Finally, a check valve is positioned intermediate and in fluid connection with the vacuum pump and nozzle for preventing loss of vacuum upon cessation of pressurized fluid flow through the vacuum pump.

10 Claims, 5 Drawing Sheets

PORTABLE PNEUMATIC VACUUM SOURCE APPARATUS AND METHOD

BACKGROUND OF THE INVENTION

1. Technical Field

This invention relates to portable pneumatic vacuum apparati and methods and, more particularly, to a portable pneumatic vacuum source including a source of pressurized fluid, a pressurized gas-driven ejector vacuum pump in fluid connection with the pressurized fluid source and a nozzle in vacuum connection with the vacuum pump such that fluid movement through the vacuum pump generates a vacuum in the nozzle, with a particular advantage being that the pressurized gas-driven vacuum pump is extremely quiet to allow for active listening for leaks in a vacuum system.

2. Description of the Prior Art

Vacuum sources are commonly used in connection with automobiles for testing a variety of automotive systems such as vacuum motors, control valves and pistons.

Various hand-operated vacuum sources have been proposed for providing a vacuum for testing of automobile vacuum systems, such as the Mityvac, produced by Neward Enterprises, Inc. of Cucamonga, Calif. Alternatively, various mechanical-type vacuum pumps have been used to generate a vacuum. These mechanical-type pumps are commonly driven by electric motors, internal combustion engines or various hydraulic systems and include such pump types as the piston pump, membrane pump, vane pump and Roots pump. The main disadvantage encountered in using such a mechanical pump, however, is that each of these pumps produces a relatively high level of noise which interferes with the ability of the operator to actively listen for leaks in a vacuum system. There is therefore a need for a substantially quiet vacuum-generating system for use in detecting leaks in vacuum systems of an automobile.

A similar problem encountered in the prior art is that most vacuum systems presently used in laboratory situations or in cleaning situations are quite noisy, due to the mechanical vacuum pump used in the system. While such systems are acceptable in some instances, a noisy system is unacceptable for use in sensitive experiments conducted in the laboratory or for use in cleaning in an office or work environment. For example, cleaning of computer keyboards and the like in large offices is preferably performed as quietly as possible, so as not to disturb other workers not affected by the cleaning process. It is also important that the vacuum system, in addition to being relatively silent, be generally portable to permit cleaning of various locations. Finally, it is important that the vacuum system be capable of producing a substantial level of airflow to thoroughly clean the surface selected for cleaning. At present, no example is found in the prior art which satisfies all of these requirements.

Another problem encountered in the prior art is that most vacuum-producing systems are not adjustable to provide different levels of vacuums. For example, most electric type vacuum pumps either are on or off, thus producing only a single level of vacuum when the device is activated. While such a system is acceptable for some uses, such as in a cleaning situation, these types of vacuum systems are clearly unacceptable for use in testing automobile systems or for use in laboratory situations. There is therefore a need for a vacuum source which will produce varying levels of vacuum quickly and accurately.

Various devices have been proposed in the prior art for detecting pressure leaks from various elements, including Himmelstein, 4,542,643, Soviet Union, 748-158, and Gandolfo, 3,377,844. However, none of these devices appear to be easily portable and all seem to utilize noisy mechanical-type vacuum pumps, which, as discussed previously, it is highly undesirable.

Therefore, an object of the present invention is to provide an improved portable pneumatic vacuum source.

Another object of the present invention is to provide a portable pneumatic vacuum source which includes a source of pressurized fluid, a pressurized gas-operated vacuum pump in fluid connection with the pressurized fluid source and a nozzle in vacuum connection with the vacuum pump.

Another object of the present invention is to provide a portable pneumatic vacuum source as described above which further includes a pressure regulator and filter combination interposed between the source of pressurized fluid and the vacuum pump and a relief valve intermediate the pressurized fluid source and vacuum pump for limiting pressure of the pressurized fluid.

Another object of the present invention is to provide a portable pneumatic vacuum source as described above which further includes a check valve intermediate the vacuum pump and nozzle for preventing loss of vacuum.

Another object of the present invention is to provide a portable pneumatic vacuum source which will not produce sound in excess of about 65 dBA.

Another object of the present invention is to provide a portable pneumatic vacuum source which may be used in connection with automobile systems, specifically for performing such processes as bleeding of brake lines, removal of air from hydraulic lines and testing of climate control systems to determine operational dampers within the system.

Another object of the present invention is to provide a method of testing vacuum systems in an automobile wherein the device described above is connected to a vacuum system of an automobile and vacuum is applied to the vacuum system, the quietness of the portable pneumatic vacuum source enabling the user to detect vacuum leaks by active listening.

Another object of the present invention is to provide a method for removing particulates from a surface which includes the steps of providing an apparatus such as described above and directing the nozzle of the apparatus to the area to be cleaned.

Another object of the present invention is to provide a portable pneumatic vacuum source which may be used to provide a vacuum in a laboratory situation.

Finally, an object of the present invention is to provide a portable pneumatic vacuum source and method of using same which is quiet, efficient and safe in use.

SUMMARY OF THE INVENTION

The present invention provides a portable pneumatic vacuum source which includes a source of pressurized fluid and a vacuum pump in fluid connection with the pressurized fluid source, the vacuum pump operative to generate a vacuum in response to pressurized fluid flow therethrough. A nozzle and hose are connected to the vacuum pump in vacuum connection therewith. A pressure regulator and filter combination is positioned intermediate and in fluid connection with the pressurized fluid source and the vacuum pump for removing particulates and liquids from the pressurized fluid and adjusting pressure of the pressurized fluid entering the vacuum pump. Also, a relief valve is provided intermediate and in fluid connection with the pressurized fluid source and vacuum pump for limiting pressure of the pressurized fluid flowing to the vacuum pump. Finally, a check valve is positioned intermediate and in fluid connection with the vacuum pump and nozzle for providing loss of vacuum.

The present invention also contemplates methods for testing vacuum systems in an automobile, providing vacuum in a laboratory setting and removing particulates from a surface to be cleaned, each method including the step of providing a portable pneumatic vacuum source as described above and subsequently applying the vacuum source in a specific series of steps.

The present invention thus provides a relatively silent portable pneumatic vacuum source for use in a variety of situations where portability and quietness are two essential requirements. For example, when a portable vacuum source is used in testing vacuum systems in an automobile, it is highly desirable that the vacuum source be quiet enough to allow for active listening for leaks in the vacuum system. Likewise, for cleaning of surfaces in an office setting or the like, it is important to be as quiet as possible so as to disturb the smallest number of people. Finally, application of a specific level of vacuum in a laboratory situation is important in numerous experiments, in addition to the vacuum source being easily portable to be used with experiments in different locations in a laboratory. It is thus seen that the present invention provides a substantial improvement over those devices found in the prior art.

DESCRIPTION OF THE PREFERRED EMBODIMENT

Figure 1:
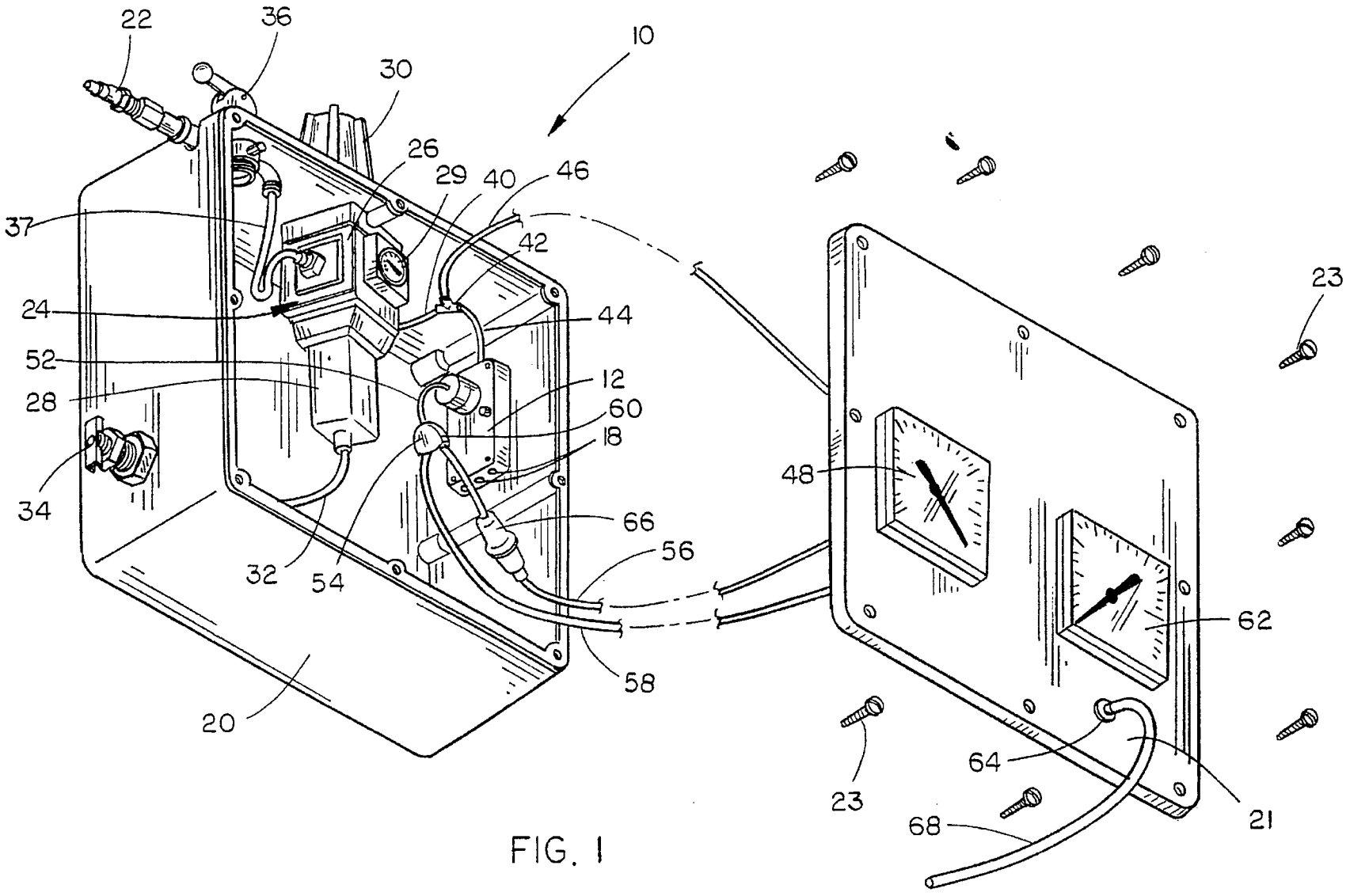
FIG. 1 is a perspective view of the portable pneumatic vacuum source of the present invention showing the internal features of the vacuum source.

The portable pneumatic vacuum source 10 of the present invention is shown in its preferred embodiment in FIGS. 1–5 as including a pressurized gas-driven ejector vacuum pump 12 which is preferably capable of generating a vacuum of at least 28" Hg at sea level and produces a sound level no greater than 65 dBA for use in automobile testing and the like. An example of such a vacuum pump is the PIAB vacuum pump X5, which is manufactured by PIAB of Sweden, and which produces a maximum vacuum of 28.2" Hg and has a sound level of 62–63 dBA. Of course, various types of pressurized gas-driven ejector vacuum pumps may be substituted for the vacuum pump described herein. In fact, in use of the present invention for cleaning purposes, it is preferable that the vacuum pump 12 have a higher flow rate and a lower level of vacuum generated, an example of which is the PIAB vacuum pump L10 which produces a maximum vacuum of 19.5" Hg, yet has a higher flow rate than the X5 vacuum pump.

A standard pressurized gas-driven ejector vacuum pump includes a pressurized gas inlet 14, a vacuum inlet 16 and one or more gas exhaust outlets 18. Pressurized gas is supplied to the pressurized gas inlet 14. As the pressurized gas flows into the vacuum pump 12, it expands in one or more ejector nozzles (not shown). When expanding, the stored energy (pressure and heat) will be converted into motive energy. The speed of the pressurized gas jet increases rapidly, while the pressure and the temperature will go down, attracting more air and thereby creating a vacuum at the vacuum inlet 16. After the pressurized gas flows through the vacuum pump 12, it is released through gas exhaust outlets 18. The level of vacuum produced at the vacuum inlet 16 is directly related to the pressure of the pressurized gas entering the vacuum pump 12 at the pressurized gas inlet 14. Therefore, the level of vacuum can be precisely controlled through adjustment of the pressure and flow rate of the pressurized gas.

It is preferred that pressurized gas be supplied to the pressurized gas inlet 14 of the vacuum pump 12 through the following system. Extending outwards on one side of box 20 is a pressurized gas line connector 22 which is preferably of a type commonly used in connection with compressed air providing systems. The gas line connector 22 is mounted in fluid connection with a pressure regulator and filter combination 24 and extends exteriorly of box 20. The pressure regulator and filter combination 24 preferably consists of an adjustable pressure regulator 26 and a fluid and particulate filter 28. It is preferred that the pressure regulator 26 be mounted such that access to the pressure regulator adjustment knob 30 is facilitated, as shown in FIG. 1. In FIG. 1, the adjustment knob 30 is positioned exteriorly of the box 20 such that adjustment to the pressure flowing to vacuum pump 12 may be performed when the box 20 is closed. It is expected that pressure regulator 26 will function as a standard pressurized gas pressure regulator, of which many different kinds are commercially available. However, it is preferred that any pressure regulator used have a capacity of approximately 2 scfm of gas, a pressure rating in the neighborhood of 250 psig and a reduced pressure range of approximately 5–100 psig. Pressure regulator 26 may also include a pressure gauge 29, commonly included as a standard pressure regulator element.

It is preferred that the fluid and particulate filter 28 be capable of removing all particulates above a certain size from the pressurized gas to prevent damage to the vacuum pump 12. Also, it is preferred that the filter 28 include a manual or automatic condensate removal feature to remove suspended liquids from the pressurized gas. It is preferred that the filter be rated for 25 microns nominal and have a 5 psig maximum pressure drop.

The pressure regulator 26 is necessary because many compressed air supplying systems supply compressed air at a pressure upwards of 150 psi, while most pressurized gas-driven ejector vacuum pumps have pressure ratings far below that figure. For example, the PIAB X5 vacuum pump described previously has a maximum performance pressure rating of 72.5 psi. The second reason the pressure regulator 26 is necessary in the present invention is to permit fine adjustment of the pressure of the pressurized gas flowing to the vacuum pump 12. Adjustment of the pressure of the pressurized gas flowing to the vacuum pump 12 will result in adjustment of the vacuum level produced at vacuum inlet 16.

The liquid and particulate filter 28 is likewise important to the present invention, as the filter 28 removes debris from the pressurized gas stream which could potentially block the vacuum pump 12, thus degrading performance of the vacuum pump 12. Any fluids and particulates removed from the pressurized gas are passed to the bottom of the filter 28 where they then pass through a tube 32 and through outflow spigot 34 which is mounted on one side of box 20. Outflow spigot 34 may be turned off to prevent release of liquids and particulates at undesirable times.

In some embodiments of the present invention, such as that shown in FIG. 1, it may be preferable to include an on/off valve 36 interposed between the pressurized gas line connector 22 and the pressure regulator and filter combination 24 and in fluid connection therewith by an on/off valve gas line 37 such that the pressurized gas flow to the pressure regulator 26 may be stopped without resorting to shutting off of the pressurized gas source 38. Of course, numerous types of on/off valves may be used with the present invention, although it is preferred that the valve 36 have a capacity of approximately 2 scfm of gas and a pressure rating of at least 250 psig.

Figure 3:
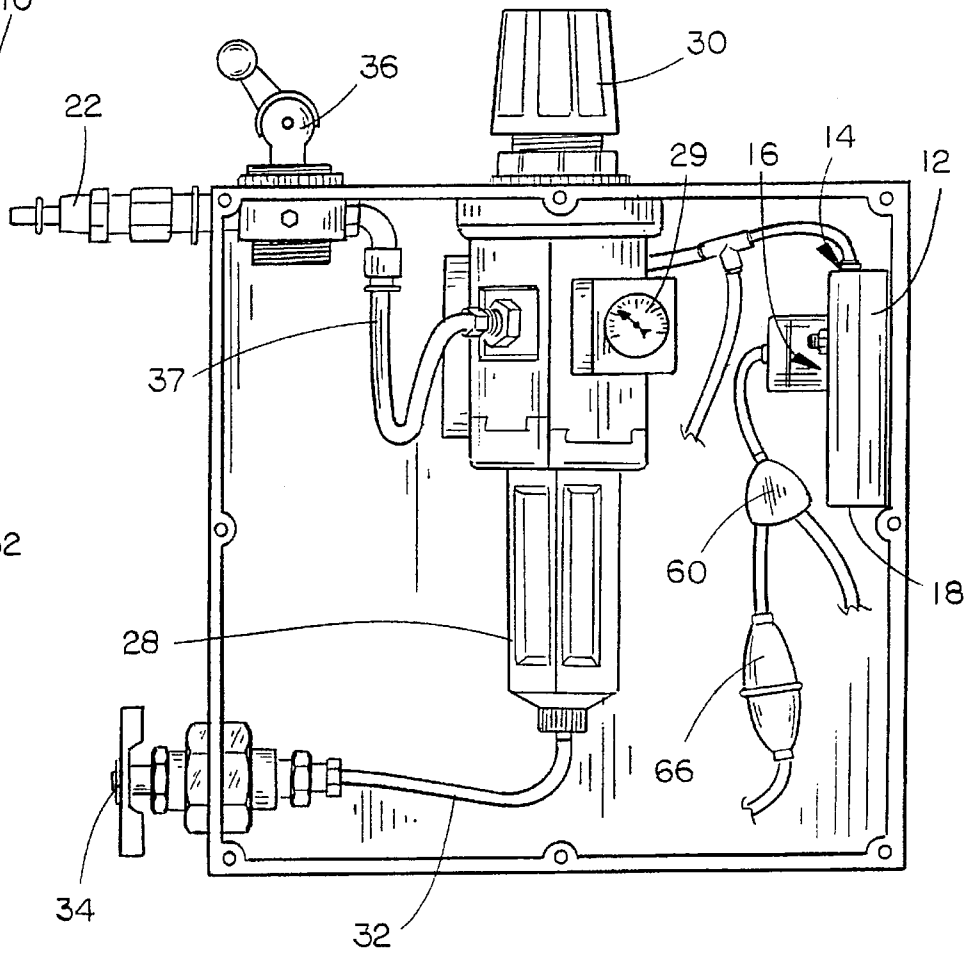
FIG. 3 is a front sectional elevational view of the vacuum source.

The reduced pressure gas exits the pressure regulator 26 through outlet 27 and flows through first gas tube 40, as shown in FIGS. 1 and 3. Connected to the opposite end of first gas tube 40 is a T-connector 42 from which extends second gas tube 44 and pressure gauge gas tube 46. Second gas tube 44 extends and is connected to pressurized gas inlet 14 of vacuum pump 12, thus completing the flow route of pressurized gas between pressurized gas line connector 22 and vacuum pump 12.

Figure 2:
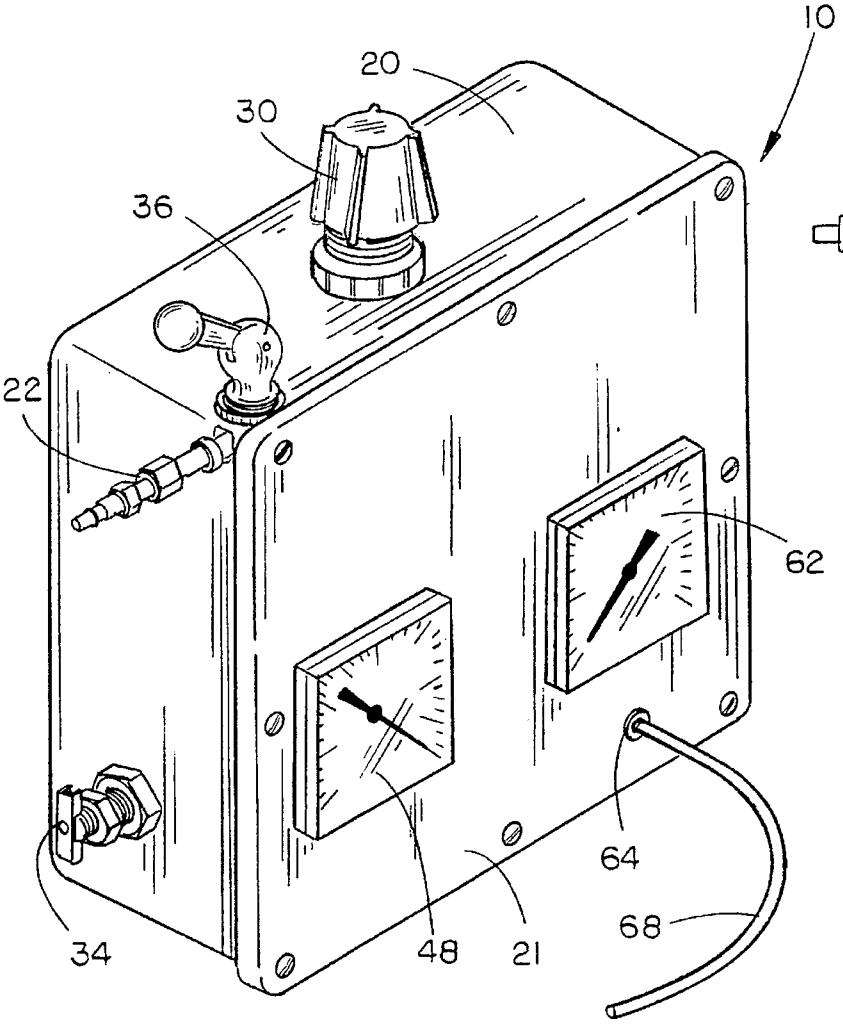
FIG. 2 is a perspective view of the portable pneumatic vacuum source with the box lid in place.

Pressure gauge gas tube 46 extends from T-connector 42 to a pressure gauge 48 which is preferably mounted on box lid 21 of box 20 such that the pressure gauge 48 may be read when box 20 is closed. It is preferred that the pressure gauge 48 be a standard type pressure gauge capable of reading pressures ranging from 0 to approximately 160 psig. The location of pressure gauge 48 on box lid 21 is best shown in FIG. 2. Box lid 21 is secured to box 20 by screws 23, as shown in FIG. 1.

In some embodiments of the present invention, it may be preferable to include a pressure relief valve 50 interposed between the pressure regulator and filter combination 24 and vacuum pump 12 and in fluid connection therewith to prevent excessive pressures from reaching the vacuum pump 12 which could cause damage to the vacuum pump 12. A preferred relief valve 50 would discharge over-pressurized gas to the atmosphere and would preferably be preset to release gas at approximately 100 psig. In some circumstances, it is vitally important to include relief valve 50, for example, when the compressor supplying air has been set at very high pressures (i.e. above 150 psi). If the relief valve 50 is not in line, damage may be caused to the various structures in the vacuum source 10. However, when the portable pneumatic vacuum source 10 of the present invention is used with relatively low pressure pressurized gas sources 38 (sources under 100 psig), pressure relief valve 50 is not necessary.

As discussed previously, pressurized gas flowing through vacuum pump 12 generates a vacuum at vacuum inlet 16. Connected to vacuum inlet 16 is first vacuum line 52 which is connected at the opposite end to T-connector 54. It is preferred that the connection of first vacuum line 52 to vacuum inlet 16 be an airtight fitting such as that shown in FIG. 3. Extending from and connected to T-connector 54 are second vacuum line 56 and vacuum gauge vacuum line 58. In one embodiment, the T-connector 54 and the vacuum connections to first vacuum line 52, second vacuum line 56 and vacuum gauge vacuum line 58 may be enveloped in a sealing compound such as a rubberized silicon gel, shown in FIG. 1 as gel ball 60. Gel ball 60 thus prevents vacuum leakage from the connections of first vacuum line 52, second vacuum line 56 and vacuum gauge vacuum line 58 at T-connector 54. It is preferred, however, that T-connector 54 be a standard barbed hose connector having three projecting hollow barbed sections which are inserted into first vacuum line 52, second vacuum line 56 and vacuum gauge vacuum line 58 and secured thereon by the barbs on the barbed sections.

Vacuum gauge vacuum line 58 extends from T-connector 54 to a vacuum gauge 62 mounted on box lid 21 of box 20 adjacent pressure gauge 48 such that vacuum gauge 62 is readable when box lid 21 closes box 20. It is preferred that vacuum gauge 62 be a standard-type vacuum gauge which displays any vacuum range between 0" and 30" Hg. It is to be understood that pressure gauge 48 and vacuum gauge 62 each function in the standard manner understood by those skilled in the art.

Second vacuum line 56 extends from T-connector 54 to a box-mounted vacuum line fitting 64 which extends through box lid 21, as shown in FIG. 1. Vacuum line fitting 64 is preferably a female-to-female hose connector which has one male connector on either side of the box lid 21. Second vacuum line 56 is thus connected to the interior male connector of vacuum line fitting 64.

In some embodiments, second vacuum line 56 further includes a filter 66 interposed between vacuum line fitting 64 and T-connector 54. Filter 66 prevents particulates and liquids passing through second vacuum line 56 from entering vacuum pump 12, as such particulates and liquids could clog the vacuum pump 12 thus reducing the efficiency of the vacuum pump. It is preferred that filter 66 be a standard cartridge-type filter consisting of polyester fibers or the like, and be quickly and easily replaceable to allow for replacement of dirty filters with clean filters.

FIG. 2 best exhibits the connection of external vacuum line 68 to vacuum line fitting 64 on the outer surface of box lid 21. External vacuum line 68 may be connected to various attachments to perform the required functions for which the present invention is designed, as will be discussed below.

It is preferred that output tube 32, first gas tube 40, second gas tube 44, pressure gauge gas tube 46, first vacuum line 52, second vacuum line 56, vacuum gauge vacuum line 58 and external vacuum line 68 all be constructed of similar materials, specifically, reinforced rubber tubing having an inner diameter of ⅛" to ¼" and which is highly resistant to expansion or compression from pressure or lack thereof. Of course, various other types of tubing may be substituted for the reinforced rubber tubing described above, but it is preferred that any such tubing be highly resistant to pressure differentials and leaks to provide a long-lasting, reliable portable pneumatic vacuum source.

Figure 5:
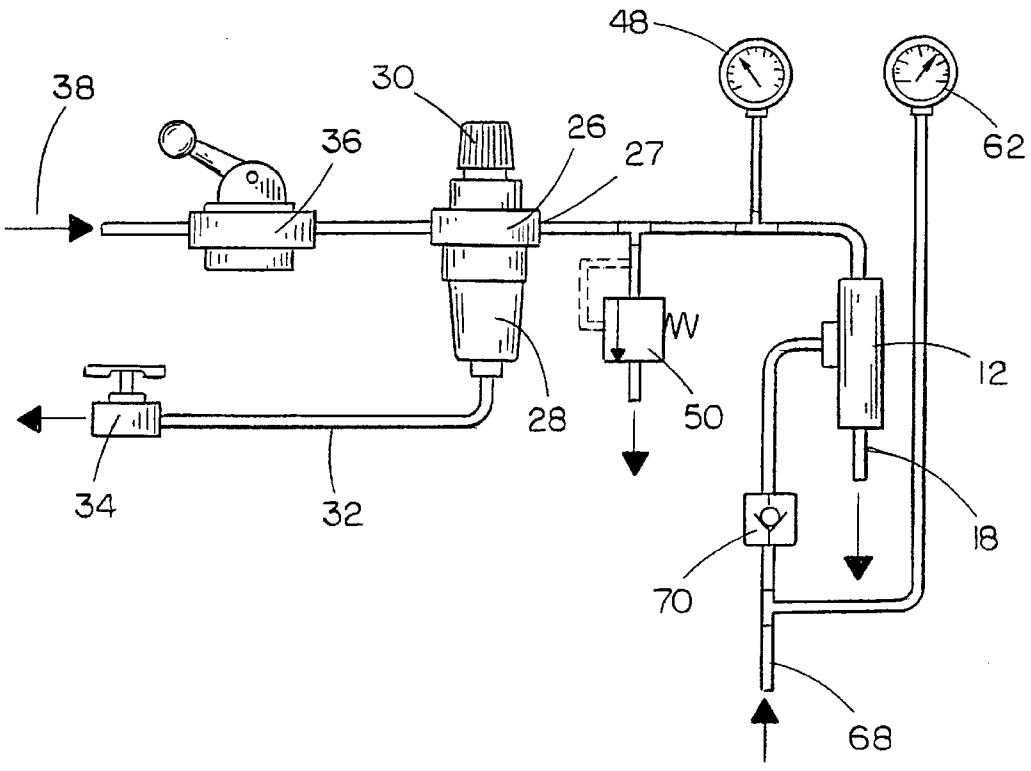
FIG. 5 is a schematic diagram of the portable pneumatic vacuum source which more clearly shows the connection of elements within the vacuum source.
Figure 4:
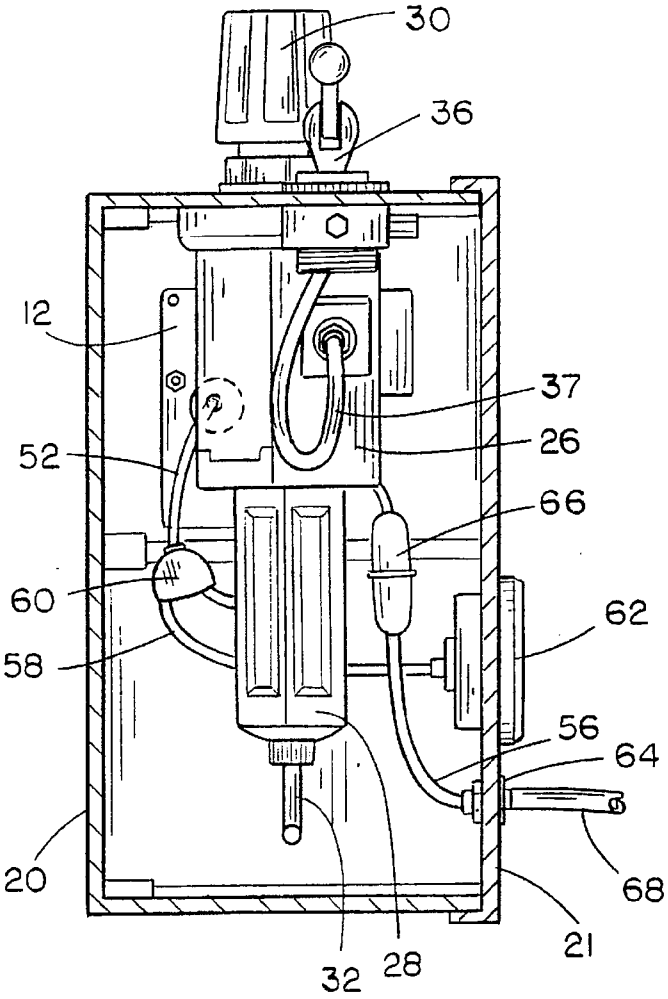
FIG. 4 is a side sectional elevational view of the portable pneumatic vacuum source.

In some embodiments, like that shown in FIG. 5, it is preferred that first vacuum line 52 further include a check valve 70 which is preferable a "zero leak" design to prevent dissipation of the vacuum within first vacuum line 52 during periods of non-flow of pressurized gas through vacuum pump 12. Check valve 70 is especially necessary for extended vacuum decay testing, such as testing for slow leaks. Of course, use of a check valve 70 is not necessary with the present invention.

Figure 6:
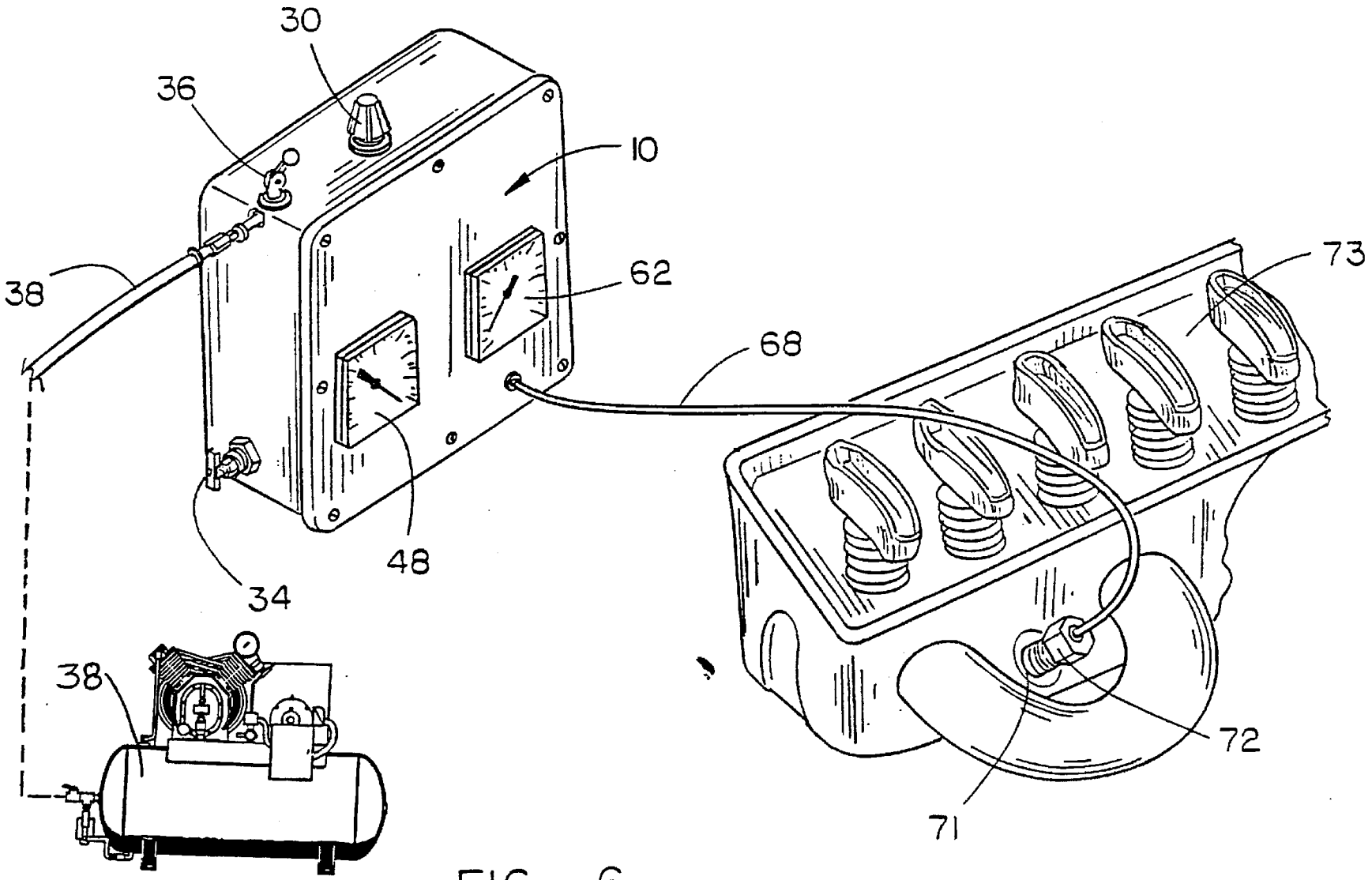
FIG. 6 is a perspective view of the present invention connected to a car engine valve, thus being utilized to test vacuum systems in an automobile.
Figure 7:
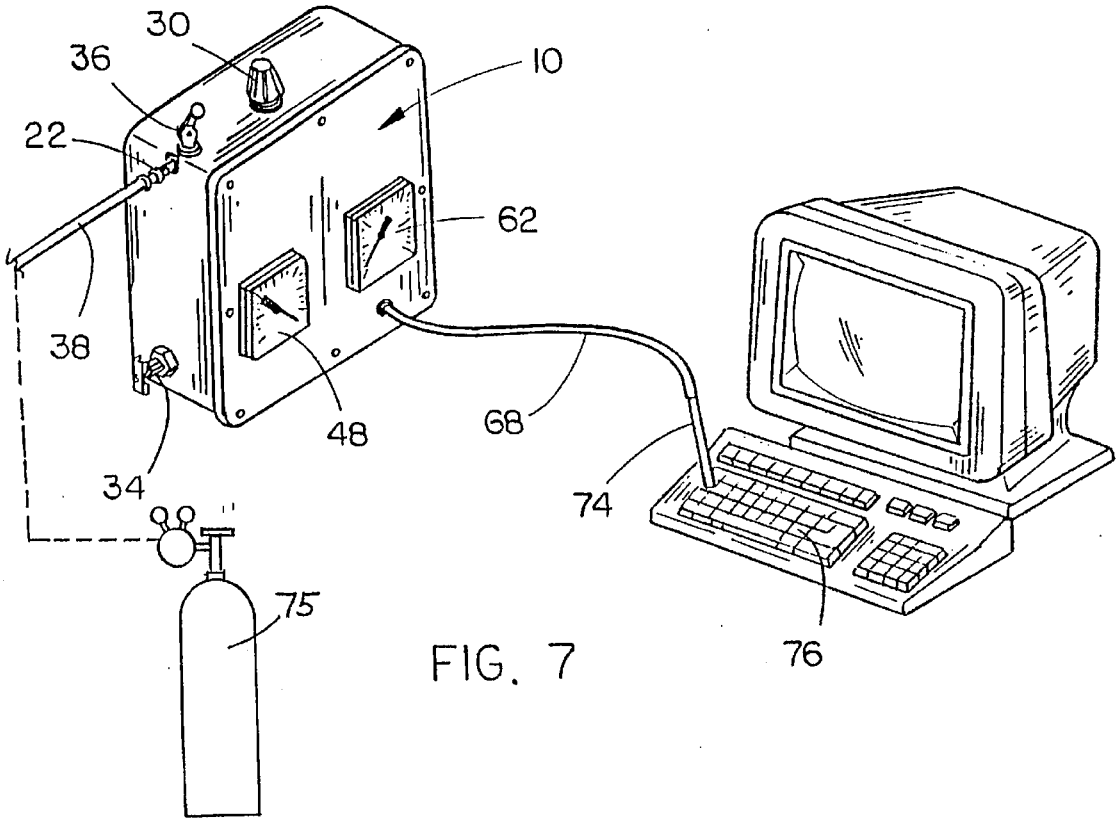
FIG. 7 is a perspective view of the portable pneumatic vacuum source of the present invention cleaning a computer keyboard.
Figure 8:
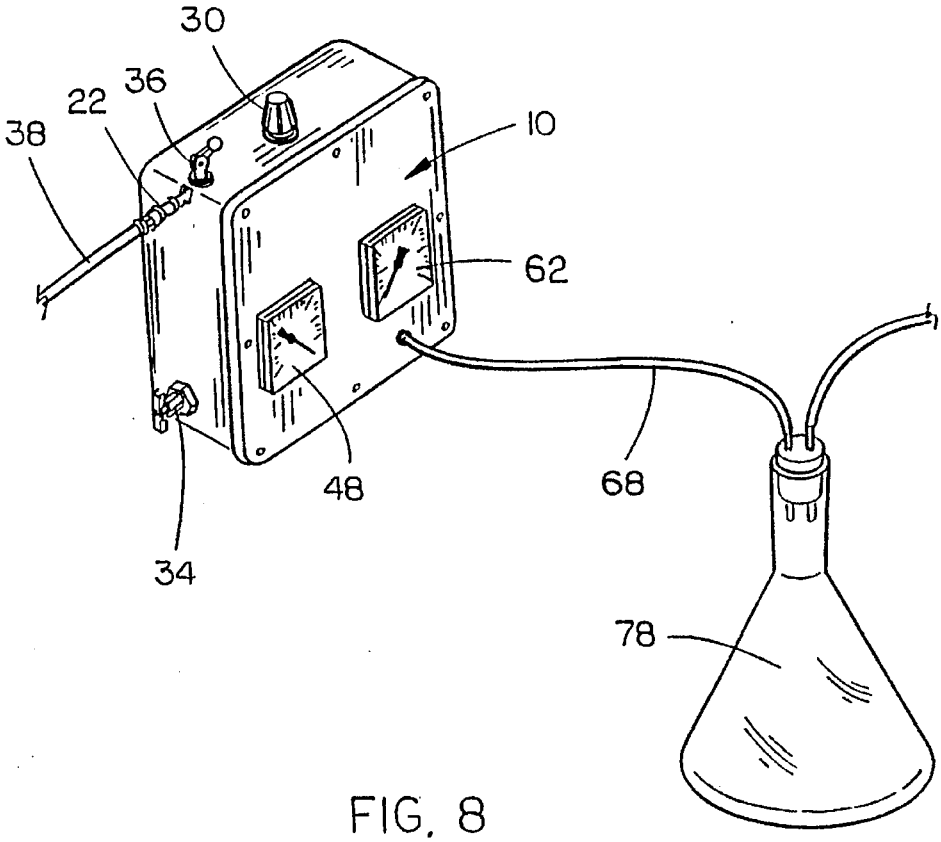
FIG. 8 is a perspective view of the present invention connected to a beaker in a laboratory for producing a vacuum within the beaker.

FIGS. 6–8 disclose methods by which the apparatus of the present invention may be used. FIG. 6 shows the portable pneumatic vacuum source 10 of the present invention being used to check for cylinder leakage in an automobile engine 73. Varying compression ratios, emission controls and more critical performance and economy demands have made cylinder leakage testing a necessity. While it is normal for a small amount of air to escape past the piston rings of an engine, any other excessive leakage indicates trouble which must be corrected before satisfactory performance in the engine can be expected. The leakage test described below should be performed when the piston of the cylinder is at top dead center with both valves closed. Various methods may be employed to determine if the piston is at top dead center, all of which would be known and understood by a person skilled in the art of examining automobile engines.

With the piston positioned at top dead center, the external vacuum line 68 of the present invention is connected to the spark plug hole 71 of the cylinder to be tested. An adaptor fitting 72 may be required to effect a leak-proof seal. Of course, the portable pneumatic vacuum source 10 is connected to a pressurized gas source 38, which may be either a compressed air line 38, as shown in FIG. 6, or a tank of pressurized gas such as nitrogen. On/off valve 36 is switched to allow for flow of pressurized gas through pressurized gas line connector 22 into pressure regulator and filter combination 24. Pressure regulator adjustment knob 30 is adjusted to allow a specific pressure of pressurized fluid to vacuum pump 12. Pressurized gas then flows through first gas tube 40, through T-connector 42 and through second gas tube 44 into vacuum pump 12 thus generating a vacuum at vacuum inlet 16. Vacuum is thus generated in first vacuum line 52, T-connector 54, second vacuum line 56 and external vacuum line 68 in turn. The pressure of pressurized gas through vacuum pump 12 should be adjusted by pressure regulator 26 until vacuum gauge 62 shows that a vacuum of approximately 5" Hg is being produced.

Following adjustment of the portable pneumatic vacuum source 10 to generate a vacuum of approximately 5" Hg, the pressure of pressurized gas is increased to generate a vacuum of approximately 15" Hg. Pressurized gas flow is then cut off by shifting on/off valve 36 to the off position. Check valve 70 engages to prevent loss of vacuum in first vacuum line 52 and thereby in second vacuum line 56, vacuum gauge vacuum line 58 and external vacuum line 68. The cylinder being tested should slowly lose the vacuum level within the cylinder, which will be represented by movement of vacuum gauge 62 from approximately 15" Hg to lower and lower readings. Substantial leaks within the cylinder are disclosed when the vacuum within the cylinder is released relatively quickly, shown by relatively quick movement of the needle of vacuum gauge 62 towards the lower end of the vacuum scale. Should this situation occur, there is most likely a leak in one of the intake valves, exhaust valves, head gasket, head, block or excessive leakage around the piston rings. Further investigation will uncover the source of the excessive leakage.

Additionally, the portable pneumatic vacuum source 10 of the present invention is extremely quiet and thus may be used to discover location of leaks within certain lines in the automobile system. For example, in older cars with heavy buildup of underbody rust and debris, location of a small leak in the fuel line may be difficult. To determine location of a leak in the fuel line, the following procedure would be undertaken. First, the line from the tank to the fuel pump would be plugged. The other end of the fuel line would be disconnected at the fuel tank and the external vacuum line 68 of the present invention would be connected thereto. Following the procedure described previously, a vacuum of approximately 15" to 20" Hg would be generated in the external vacuum line 68. The operator of the vacuum source 10 would then go slowly along the fuel line listening carefully for high-pitched whistling noises or the like which indicate the presence of a leak in the fuel line. Upon discovery of the location of the leak, the leak would then be sealed by any appropriate means, such as tape or heat sealing methods. Such investigation cannot be done by using mechanical vacuum pumps, as the noise emitted by such vacuum pumps would mask any whistling noise emitted by a leak in the fuel line. Other more costly, sophisticated and time-consuming methods for discovering the leak would then have to be employed. It is therefore seen that the present invention may be used in numerous ways in connection with automobiles to determine location and severity of problems within the automobile engine, fuel, emission and vacuum systems.

Other systems on automobiles can also be easily tested or repaired by use of the present invention. For example, in the hydraulic systems of cars, particularly in the brake systems, it is often necessary to either replace the old hydraulic fluid with new hydraulic fluid or bleed the hydraulic lines to remove air from the lines, as air present in the hydraulic lines degrades the performance of the hydraulic system. The portable pneumatic vacuum source 10 of the present invention may be connected to a hydraulic system in an automobile via an intermediate container and activated to draw hydraulic fluid through the system into the container. This process is continued until all the air is bled from the hydraulic system or the new hydraulic fluid is in place within the system. The ease and rapidity with which this process may be accomplished is only made possible by the use of the present invention.

FIG. 7 discloses a method of cleaning a computer keyboard by using the apparatus of the present invention. It is necessary to periodically clean various computer elements, specifically the keyboard and internal workings of the monitor. It is impractical to remove such items from their location of use for cleaning, and therefore it is necessary to transport the cleaning system to the location of the computer system. However, use of conventional vacuum sources in an office setting is highly disruptive due to the noise generated by commercial vacuum systems. This is especially true in large secretarial pools where cleaning of one computer unit should not interfere with continued use of numerous other units which are not being cleaned at the same time. Many office workers cannot function efficiently in an atmosphere of noise pollution, which would be generated by use of commercial vacuum systems in cleaning computers in the area.

The present invention provides a method for removing particulates from a surface to be cleaned which avoids those problems encountered in the prior art. It is preferred that external vacuum line 68 be connected to a straw-like nozzle 74 which preferably has an internal diameter of approximately ¼ inch. A vacuum is generated by the portable pneumatic vacuum source 10 of the present invention in the manner described previously, although it is preferred that for use in cleaning surfaces, the pressurized gas source 38 be a tank of pressurized gas such as argon, carbon dioxide, nitrous oxide or nitrogen, but preferably nitrogen, as release of nitrogen into the atmosphere is generally harmless. In this manner, the portable pneumatic vacuum source 10 is truly portable and may be used in almost any location. Commercially available large bottles of pressurized nitrogen hold approximately 220 cubic feet of nitrogen, which, it is believed, will supply sufficient pressurized gas to the portable pneumatic vacuum source 10 to allow up to 3 hours of continuous operation.

For cleaning particulates from a surface, it is preferred that the portable pneumatic vacuum source 10 generate a vacuum between 15" and 25" Hg to produce the best cleaning results. Of course, in this method, it is vitally important that vacuum source 10 include a highly efficient filter 66 to prevent particulates from entering the vacuum pump 12 through second vacuum line 56 and first vacuum line 52. It is further preferred that the portable pneumatic vacuum source 10 include an additional vacuum filter (not shown) with a larger capacity than filter 66, the additional filter acting as a type of "dust bag" of the kind commonly found in vacuum cleaners or the like. While the vacuum is being generated, nozzle 74 is moved into various areas to be cleaned on the keyboard 76, as shown in FIG. 7. As discussed previously, the vacuum pump 12 will produce noise no greater than 65 dBA, and this noise level is greatly reduced by enclosure of vacuum pump 12 within box 20. It is thus expected that the noise level produced by the portable pneumatic vacuum source 10 will be substantially below the ambient noise level within any office situation. Therefore, cleaning of the keyboard 76 may be effected without disturbing other persons in the office, even those seated relatively close to the computer unit being cleaned. Also, the relatively high level of vacuum generated by the portable pneumatic vacuum source 10 results in a highly efficient and complete cleaning of any surface over which nozzle 74 is passed. It is therefore seen that the method of using the apparatus of the present invention described above is superior to any method shown in the prior art.

Finally, FIG. 8 discloses a method of using the apparatus of the present invention in a laboratory situation for providing a portable vacuum source for experiments and the like. Many laboratories are equipped with supply lines which supply compressed air, natural gas and electricity to various locations in the laboratory. However, most laboratories do not include a centralized vacuum source having outlets at various locations in the laboratory. There is therefore a need for a portable pneumatic vacuum source such as the present invention. For example, one conceivable use for a portable pneumatic vacuum source 10 would be to provide vacuum in a beaker 78 to lower the pressure within the beaker. The lower pressure within the beaker would allow the contents of the beaker to reach boiling point much more quickly, as less energy must be transferred to the contents of the beaker to cause boiling. In such a case, it may be preferable to apply up to 28" Hg of vacuum to the beaker 78 to lower the boiling point of the liquid therein to a much lower temperature than would ordinarily be required. Of course, many experiments in a laboratory setting require strict non-interference conditions to provide optimal results. The method of the present invention is ideal for such situations, as the portable pneumatic vacuum source 10 of the present invention produces substantially no noise and is virtually vibration free. Use of the present invention in a laboratory setting is thus superior to use of other vacuum sources disclosed in the prior art.

The above description clearly points to the unique and highly desirable features of the present invention. The portable pneumatic vacuum source 10 is extremely simple and convenient to use, and unlike some devices found in the prior art, requires almost no mechanical effort to operate. Furthermore, the rapidity with which the present invention evacuates containers and performs testing is far superior to those devices found in the prior art. A further important feature of the present invention is that the level of vacuum generated by the portable pneumatic vacuum source is quickly and accurately adjustable from 0" Hg up to the maximum level of vacuum producable by the vacuum pump. The adjustment of the vacuum level is done by merely adjusting the pressure regulator, which can be performed with one hand. When the pressure regulator is combined with the vacuum and pressure gauges described previously, experiments and/or tests may be repeated with a high degree of accuracy regarding the precise level of vacuum applied during the experiment and/or test. This ability to quickly, easily and accurately adjust the level of vacuum generated by the present invention is a feature which cannot be overestimated. It is thus seen that the present invention is far superior to any vacuum devices found in the prior art.

It is to be understood that numerous modifications, additions and substitutions may be made to the apparatus and method of the present invention which fall within the intended broad scope of the appended claims. For example, any of the components of the portable pneumatic vacuum source 10 may be modified so long as the new element performs within the stated broad ranges. Additionally, the portable pneumatic vacuum source 10 may be used in other situations than those described above, such as in aircraft instrument testing, and is particularly suited for use in situations requiring vacuum sources which are quiet and generally vibration-free. Therefore, it is to be understood that the present invention is not to be limited by the scope of this specification, but rather by the scope of the appended claims which are set forth below.

There has thus been set forth and described a portable pneumatic vacuum source which accomplishes at least all of the stated objectives.

I claim:

1. A portable pneumatic vacuum source comprising;

a source of pressurized fluid;

vacuum pump means in fluid connection with said pressurized fluid source, said vacuum pump means operative to generate a vacuum in response to pressurized fluid flow therethrough;

nozzle means in vacuum connection with said vacuum pump means;

filter means intermediate and in fluid connection with said pressurized fluid source and said vacuum pump means for removing particulates and liquids from said pressurized fluid;

pressure regulator means intermediate and in fluid connection with said pressurized fluid source and said vacuum pump means for adjusting pressure of said pressurized fluid entering said vacuum pump means;

relief valve means intermediate and in fluid connection with said pressurized fluid source and said vacuum pump means for limiting pressure of said pressurized fluid; and check valve means intermediate and in vacuum connection with said vacuum pump means and said nozzle means for preventing loss of vacuum.

2. The portable pneumatic vacuum source of claim 1 wherein said source of pressurized fluid comprises a compressor and compressed air hose delivery system adapted to be connected to said portable pneumatic vacuum source.

3. The portable pneumatic vacuum source of claim 1 wherein said source of pressurized fluid comprises a bottle of pressurized gas, the gas being selected from the group consisting of nitrogen, argon, carbon dioxide and nitrous oxide.

4. The portable pneumatic vacuum source of claim 1 where said vacuum pump means comprises a pressurized gas-driven ejector vacuum pump capable of generating a vacuum of at least 28" Hg at sea level and producing a maximum sound level of 65 dBA.

5. The portable pneumatic vacuum source of claim 4 wherein said vacuum pump means further comprises a pressurized gas-driven ejector vacuum pump having a pressurized gas inlet through which pressurized gas is introduced, at least one gas exhaust outlet for releasing pressurized gas from said vacuum pump and a vacuum inlet interposed between said pressurized gas inlet and said gas exhaust outlet such that as pressurized gas flows through said pressurized gas inlet and expands in said ejector vacuum pump, thereby reducing the pressure of the pressurized gas in drawing air through said vacuum inlet, vacuum is generated in said vacuum inlet.

6. The portable pneumatic vacuum source of claim 1 wherein said pressure regulator means and said filter means comprise a pressure regulator and filter combination which includes an adjustable pressure regulator for adjustment of the pressure of the pressurized gas flowing to said vacuum pump means, and said filter for removing fluids and particulates from the pressurized gas to prevent damage to said vacuum pump means.

7. The portable pneumatic vacuum source of claim 1 wherein said relief valve means comprises a pressure relief valve operative to vent overpressurized gas to the atmosphere upon the pressurized gas exceeding a preset pressure limit.

8. The portable pneumatic vacuum source of claim 1 wherein said check valve means comprises a "zero leak" vacuum check valve for preventing dissipation of the vacuum within said nozzle means upon shut-off of pressurized gas flow through said vacuum pump means.

9. The portable pneumatic vacuum source of claim 1 further comprising a pressure gauge intermediate and in fluid connection with said pressure regulator means and said vacuum pump means for measuring and displaying the pressure of the pressurized fluid flowing between said pressure regulator means and said vacuum pump means such that accurate adjustment of the pressure of the pressurized fluid may be resulted.

10. The portable pneumatic vacuum source of claim 1 further comprising a vacuum gauge intermediate and in vacuum connection with said check valve means and said nozzle means for measuring and displaying the vacuum level within said nozzle means such that the level of vacuum within said nozzle means is measurable upon adjustment of pressurized fluid flow through said vacuum pump means.

* * * * *